US007937792B2

(12) United States Patent
Munn et al.

(10) Patent No.: US 7,937,792 B2
(45) Date of Patent: May 10, 2011

(54) POLE SCRUBBER

(75) Inventors: Jamie Munn, Maitland (CA); Chan Tung Sung Nicholas, Sai Wan Ho (HK)

(73) Assignee: Black & Decker Inc., Newark, DE (US)

( * ) Notice: Subject to any disclaimer, the term of this patent is extended or adjusted under 35 U.S.C. 154(b) by 1177 days.

(21) Appl. No.: 11/583,660

(22) Filed: Oct. 19, 2006

(65) Prior Publication Data

US 2008/0092311 A1 Apr. 24, 2008

(51) Int. Cl.
*A46B 13/02* (2006.01)

(52) U.S. Cl. ..... 15/28; 15/22.1; 15/49.1

(58) Field of Classification Search ..... 15/22.1, 15/28, 49.1

See application file for complete search history.

(56) References Cited

U.S. PATENT DOCUMENTS

| | | | | |
|---|---|---|---|---|
| 2,772,430 | A | | 12/1956 | Moritt |
| 2,782,452 | A | | 2/1957 | Kitto et al. |
| 3,023,971 | A | | 3/1962 | Milhous |
| 3,027,585 | A | | 4/1962 | Freedman et al. |
| 3,058,136 | A | | 10/1962 | Rachlin |
| 3,164,855 | A | | 1/1965 | Hencken |
| 3,204,272 | A | * | 9/1965 | Greene et al. ..... 15/49.1 |
| 3,226,259 | A | | 12/1965 | Armbrust |
| 3,293,678 | A | | 12/1966 | South |
| 3,343,192 | A | | 9/1967 | Goldstein et al. |
| 3,358,309 | A | | 12/1967 | Richardson |
| 3,366,288 | A | | 1/1968 | Goldschein |
| 3,396,417 | A | | 8/1968 | Starr |
| 3,398,848 | A | | 8/1968 | Donovan |
| 3,417,417 | A | | 12/1968 | Rhodes |
| 3,443,272 | A | | 5/1969 | Trelc et al. |
| 3,447,178 | A | | 6/1969 | Pickering |
| 3,614,705 | A | | 10/1971 | Descarries et al. |
| 3,688,139 | A | | 8/1972 | Yaguchi |
| 3,731,334 | A | | 5/1973 | Carboneli |
| 3,892,004 | A | | 7/1975 | Downes |
| 3,908,220 | A | | 9/1975 | Adamson et al. |
| 3,932,908 | A | | 1/1976 | Bitgood et al. |
| 3,977,084 | A | | 8/1976 | Sloan |
| 3,987,939 | A | | 10/1976 | Pedone, Jr. et al. |
| 4,045,836 | A | | 9/1977 | Glenn |
| D246,285 | S | | 11/1977 | Gallagher |
| 4,060,870 | A | | 12/1977 | Cannarella |

(Continued)

FOREIGN PATENT DOCUMENTS

| | | |
|---|---|---|
| DE | 1 851 625 | 2/1962 |

(Continued)

OTHER PUBLICATIONS

Black & Decker Household Products catalog p. 59.

(Continued)

*Primary Examiner* — Randall Chin

(74) *Attorney, Agent, or Firm* — Harness, Dickey & Pierce, P.L.C.

(57) ABSTRACT

A scrubbing device includes a support member, a battery, and a yoke coupled to the support member. A yoke arm from the yoke is coupled to a head assembly via a cam lock. The cam lock allows the head assembly to move or be fixed in relation to the yoke assembly. The head assembly further includes an electric motor coupled to the battery, the electric motor coupled to an output member. The output member is coupled to a scrubbing accessory.

18 Claims, 8 Drawing Sheets

U.S. PATENT DOCUMENTS 4,084,281 A 4/1978 Smith
4,129,257 A 12/1978 Eggert
4,158,246 A 6/1979 Meadows et al.
4,168,560 A 9/1979 Doyel
4,188,682 A 2/1980 Burglin et al.
4,202,068 A 5/1980 Lester et al.
4,207,640 A 6/1980 Sekula et al.
D259,076 S 5/1981 Doyel
4,299,004 A 11/1981 Lancaster
4,399,578 A 8/1983 Bordeaux
4,417,826 A 11/1983 Floros
4,490,873 A 1/1985 Stratton
4,512,053 A 4/1985 Horak et al.
4,524,477 A 6/1985 Williams, III et al.
D279,626 S 7/1985 McCloskey
4,669,452 A 6/1987 Osawa
4,686,735 A 8/1987 Soeffker et al.
4,724,563 A 2/1988 Fry et al.
4,724,567 A 2/1988 Rones
4,734,954 A 4/1988 Greskovics et al.
4,748,998 A 6/1988 Färber et al.
4,763,377 A 8/1988 Madsen
4,780,992 A 11/1988 McKervey
4,782,982 A 11/1988 Ellison
D298,875 S 12/1988 Nakamura
4,792,066 A 12/1988 Kobayashi
4,826,053 A 5/1989 Keller
4,826,340 A 5/1989 Rothweiler et al.
D301,398 S 6/1989 Cheung
4,883,204 A 11/1989 Kay et al.
4,893,370 A 1/1990 Klotz
4,930,664 A 6/1990 Ellison
4,930,686 A 6/1990 Ellison
4,932,094 A 6/1990 McCowin
4,964,398 A 10/1990 Jones
D313,890 S 1/1991 Machuron
D319,734 S 9/1991 Townsend
5,044,525 A 9/1991 McKinney
5,058,229 A 10/1991 Plazanet
D321,596 S 11/1991 Zierhut
5,088,149 A 2/1992 Berg et al.
5,109,568 A 5/1992 Rohn et al.
D328,555 S 8/1992 Keller
5,157,873 A 10/1992 Rudolf et al.
5,187,827 A 2/1993 Wei
5,289,605 A 3/1994 Armbruster
D346,041 S 4/1994 Trinkaus
5,301,381 A 4/1994 Klupt
5,353,461 A 10/1994 Enriquez
5,371,912 A 12/1994 Hall
5,375,740 A 12/1994 Umetsu et al.
D354,592 S 1/1995 Powers
5,394,584 A 3/1995 Breitschmid
5,423,102 A 6/1995 Madison
D361,247 S 8/1995 Snetting et al.
D368,343 S 3/1996 Gebhard et al.
5,495,632 A 3/1996 Baker
5,500,972 A 3/1996 Foster
5,511,269 A 4/1996 Watson
5,513,409 A 5/1996 Biegel
5,588,176 A 12/1996 Sixsmith
D378,338 S 3/1997 Acciville et al.
D380,069 S 6/1997 McCracken
5,634,572 A 6/1997 Lane, Jr. et al.
D380,950 S 7/1997 Gildersleeve et al.
5,649,334 A 7/1997 Henriquez et al.
5,664,634 A 9/1997 McCracken
5,680,666 A 10/1997 Ra
D387,515 S 12/1997 Nottingham et al.
5,697,115 A 12/1997 Sciarra et al.
5,701,625 A 12/1997 Siman
5,706,541 A 1/1998 Gutelius et al.
5,709,317 A 1/1998 Bertram et al.
5,718,014 A 2/1998 deBlois et al.
5,775,539 A 7/1998 Bates et al.
5,784,744 A 7/1998 Toran
5,797,157 A 8/1998 Gregg
5,842,243 A 12/1998 Horvath et al.
5,870,790 A 2/1999 Root et al.
5,881,418 A 3/1999 Enoch
D413,445 S 9/1999 deBlois et al.
5,950,268 A 9/1999 Murphy et al.
5,956,792 A 9/1999 Gutelius et al.
5,957,387 A 9/1999 Porta et al.
5,960,503 A 10/1999 Del Pozo Y Mattei
5,978,999 A 11/1999 deBlois et al.
D417,789 S 12/1999 Murphy et al.
6,009,593 A 1/2000 Crouser et al.
6,016,812 A 1/2000 Guyann
6,026,529 A 2/2000 Caruso
6,026,993 A 2/2000 Sperna Weiland
6,031,969 A 2/2000 Burr et al.
6,058,542 A 5/2000 Lo
6,058,545 A 5/2000 Roach
6,088,873 A 7/2000 Pacchini et al.
6,112,354 A 9/2000 Stoltz et al.
6,134,738 A 10/2000 Weber
6,164,496 A 12/2000 Gregory
6,248,007 B1 6/2001 deBlois et al.
6,250,833 B1 6/2001 Perry et al.
6,253,405 B1 7/2001 Gutelius et al.
D446,281 S 8/2001 Fehl et al.
6,292,971 B1 9/2001 Chaudray
6,295,681 B1 10/2001 Dolah
6,374,447 B1 4/2002 Armbruster et al.
6,439,409 B1 8/2002 Dressel et al.
6,484,347 B1 11/2002 Wang
6,499,172 B1 * 12/2002 McCracken ..... 15/97.1
6,502,766 B1 1/2003 Streutker et al.
6,554,614 B1 4/2003 Dubbe et al.
D489,151 S 4/2004 Krieger et al.
6,752,330 B2 6/2004 DiMaggio et al.
6,886,214 B2 5/2005 Lee et al.
7,040,830 B2 5/2006 Kliegman et al.
2001/0041525 A1 11/2001 McCracken et al.
2002/0011531 A1 1/2002 DiMaggio et al.
2002/0074362 A1 6/2002 Py et al.
2002/0112741 A1 8/2002 Pieroni et al.
2002/0129835 A1 9/2002 Pieroni et al.
2003/0034358 A1 2/2003 Ma et al.
2003/0042330 A1 3/2003 Streutker et al.
2003/0052194 A1 3/2003 Streutker et al.
2003/0097724 A1 5/2003 Park
2004/0010876 A1 1/2004 Kraemer
2004/0064907 A1 4/2004 Blaustein et al.
2004/0074025 A1 4/2004 Blaustein et al.
2005/0066996 A1 3/2005 France et al.

FOREIGN PATENT DOCUMENTS

DE 32 872 11/1964
DE 66 07 845 10/1967
DE 1 921 071 11/1970
DE 1 962 595 1/1971
DE GM 74 31 959 3/1975
DE P 23 46 677 5/1980
DE G 83 32 941 2/1984
DE 36 15918 A1 11/1987
DE 3615918 11/1987
DE 87 10 130 6/1988
DE P 39 12 655 11/1989
DE G 91 00 264 5/1991
DE G 92 15 222 2/1993
DE P 42 26 928 2/1994
DE 42 34 764 C2 8/1994
DE 43 35 445 A1 4/1995
DE 43 35 075 C2 9/1995
DE 35 10 107 1/1996
DE 200 15 053 U1 11/2000
DE 40 35 791 4/2003
DE 102 12 355 A1 6/2003
DE 202 14 940 3/2004
DE 20 2004 008 250 U1 10/2004
EP 0 046 521 3/1982
EP 0 275 218 1/1988
EP 0 280 527 8/1988
EP 0 804 985 11/1997
EP 0 847 713 11/1997

| | | | |
|---|---|---|---|
| EP | 0 905 038 | | 9/1998 |
| EP | 0 990 402 | A2 | 8/1999 |
| EP | 0 990 402 | A2 | 4/2000 |
| EP | 1 529 478 | | 5/2005 |
| JP | 6-304116 | | 11/1994 |
| WO | WO 01/19228 | | 3/2001 |
| WO | WO01/96088 | | 12/2001 |
| WO | WO 02/05681 | A2 | 1/2002 |
| WO | WO02/07897 | | 1/2002 |
| WO | WO02/089632 | | 11/2002 |
| WO | WO 03/096860 | A1 | 11/2003 |
| WO | WO2004/035268 | | 4/2004 |
| WO | WO 2004/066783 | | 8/2004 |

OTHER PUBLICATIONS

Black & Decker Parts List for Scubber, (1984).
One (1) page printout of Dawn Power Dish BrushTM Advertisement from www.homemadesimple.com/dawn/dish__brush.shtml, (2007).

* cited by examiner

POLE SCRUBBER

FIELD

The present disclosure relates to cleaning devices and more specifically to an adjustable pole-mounted scrubber.

BACKGROUND

Various powered cleaning devices are known in the art. Typical powered cleaning devices include scrubbers with an electric motor driving a brush. However, many scrubbing devices have several shortcomings in that they are not readily portable, easily adjustable and/or ergonomic. For example, scrubbing devices with fixed dimensions and fixed scrubbing attachments may not be adaptable for use in some cleaning operations.

SUMMARY

In one form, the teachings of the present disclosure provide a scrubbing device. The scrubbing device can include a support member, a battery, a yoke, and a head assembly. The yoke is coupled to the support member and has a yoke arm, which is coupled to the head assembly. A cam lock releasably couples the yoke arm and the head assembly together. The head assembly has an electric motor that is coupled to the battery and an output member driven by the electric motor and coupled to a scrubbing accessory.

In another form, the teachings of the present disclosure provide a scrubbing device having a cam lock where the cam lock further includes a lock member and a lever. The lock member has a first end and a second end opposite the first end, with the first end engaged to a head assembly and the second end extending through a yoke arm. The lever has a cam that is pivotally coupled to the second end of the lock member.

In yet another form, the teachings of the present disclosure provide a scrubbing device that can have a cam lock that has a coupling aperture formed through the cam wherein the center of the coupling aperture is offset so that a distance from a first side to the center is greater than a distance from a second side to the center. A pin is received through the coupling aperture and engages a lock member.

The scrubbing device can also have a cam lock with a cam that includes a first cam portion and a second cam portion. Engagement of the first cam portion inhibits relative rotation between a head assembly and a yoke, while engagement of the second cam portion permits relative rotation between the head assembly and the yoke.

In still another form, the teachings of the present disclosure provide a scrubbing device with a head assembly that includes a detent member disposed within a detent passage, the detent passage formed in an output member. The detent member is movable between a first detent position and a second detent position radially outwardly of the first detent position. A release ring is disposed coaxially about at least a portion of the output member. The release ring has a first ring portion configured to maintain the detent member at or inwardly of the first detent position, and a second ring portion configured to permit the detent member to travel radially outwardly from the first detent position to the second detent position.

In yet another form, the teachings of the present disclosure provide methods of adjusting a scrubbing device, where the scrubbing device includes a support member; a battery; a yoke with a yoke arm, the yoke coupled to the support member; a head assembly with an electric motor and output member; a cam lock having a lever, a lock member, and a latch; and an accessory coupled to the output member. The lever is pivoted relative to the lock member to disengage the lock member from the latch. The head assembly can then be pivoted relative to the yoke. The lever is then pivoted relative to the lock member to engage the lock member to the latch; in so doing, relative rotation between the head assembly and the yoke is inhibited.

In another form, the teachings of the present disclosure provide an accessory having a connector portion and an accessory portion. The connector portion further includes a drive portion with a non-circular shape disposed about a rotational axis and a retaining portion having a groove formed about the perimeter of the non-circular shape. The accessory portion is coupled to the connector portion and includes an accessory member selected from a group consisting of pads, brushes, sponges and combinations thereof.

Further areas of applicability and advantages will become apparent from the following description. It should be understood that the description and specific examples, while exemplifying various aspects of the invention, are intended for purposes of illustration only and are not intended to limit the scope of the invention.

DRAWINGS

The drawings described herein are for illustration purposes only and are not intended to limit the scope of the present disclosure in any way.

DETAILED DESCRIPTION

Figure 1:
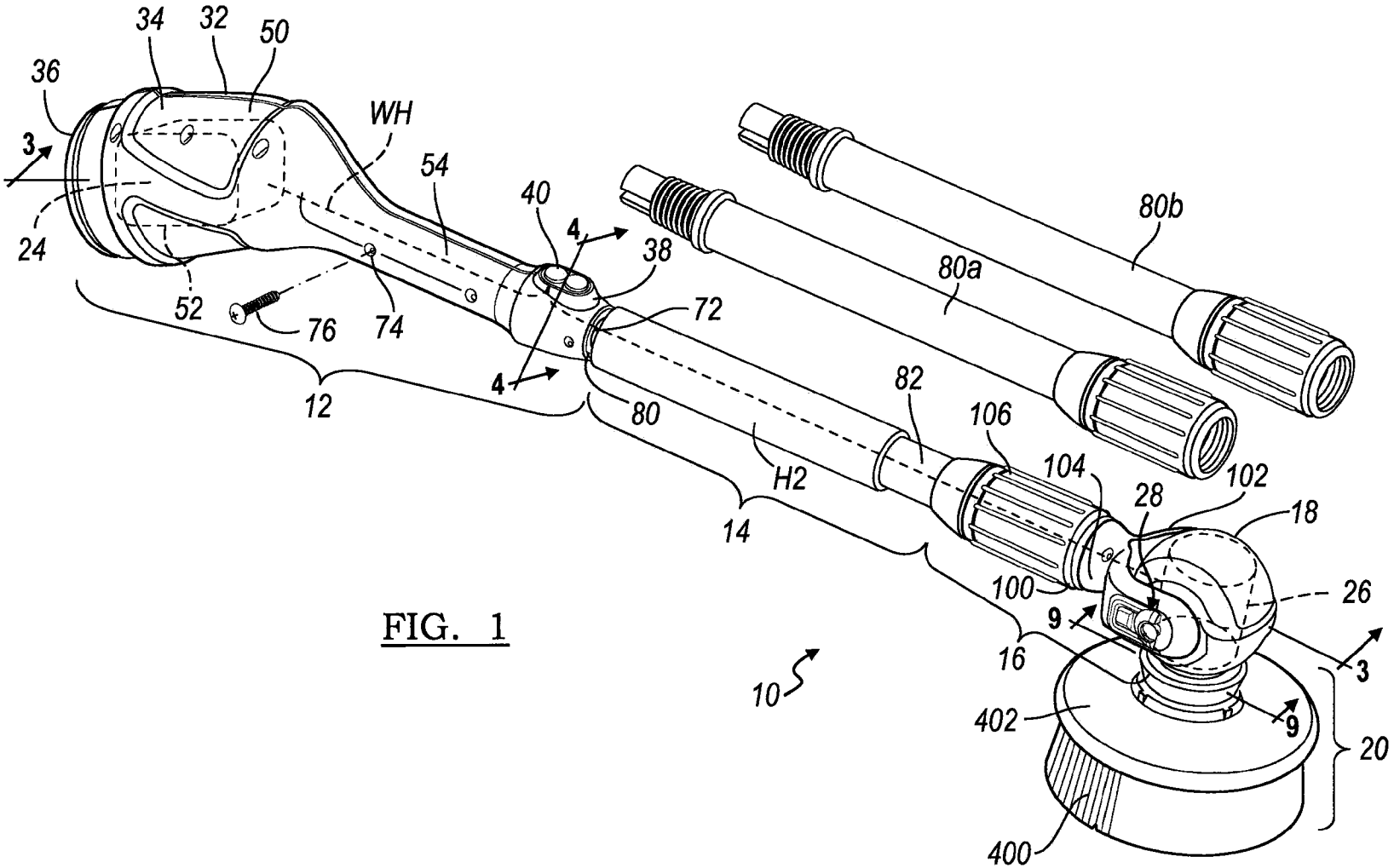
FIG. 1 is a perspective view of an exemplary pole scrubber constructed in accordance with the teachings of the present disclosure.

An exemplary scrubbing device 10 constructed in accordance with the teachings of the present disclosure is shown in FIG. 1. The scrubbing device 10 can include a housing assembly 12, a support structure 14, a yoke 16, a head assembly 18, and an accessory 20. The housing assembly 12 can be located on one end of the support structure 14 and the yoke 16 on the other end of the support structure 14. A battery 24 can be disposed within the housing assembly 12 for powering a motor assembly 26 disposed within the head assembly 18. A cam lock 28 can be used to couple the yoke 16 to the head assembly 18. The accessory 20 can be a scrubbing accessory and is coupled to the head assembly 18 such that the accessory 20 can be driven by the motor assembly 26.

The cam lock 28 can be operated in a first condition, which permits the head assembly 18 to pivot relative to the yoke 16, and a second condition that locks the head assembly 18 relative to the yoke 16. This permits the head assembly 18 of the scrubbing device 10 to be readily adjustably fixed to desired angles between the head assembly 18 and the yoke 16 or allows the head assembly 18 to pivot freely relative to the yoke 16.

Figure 2:
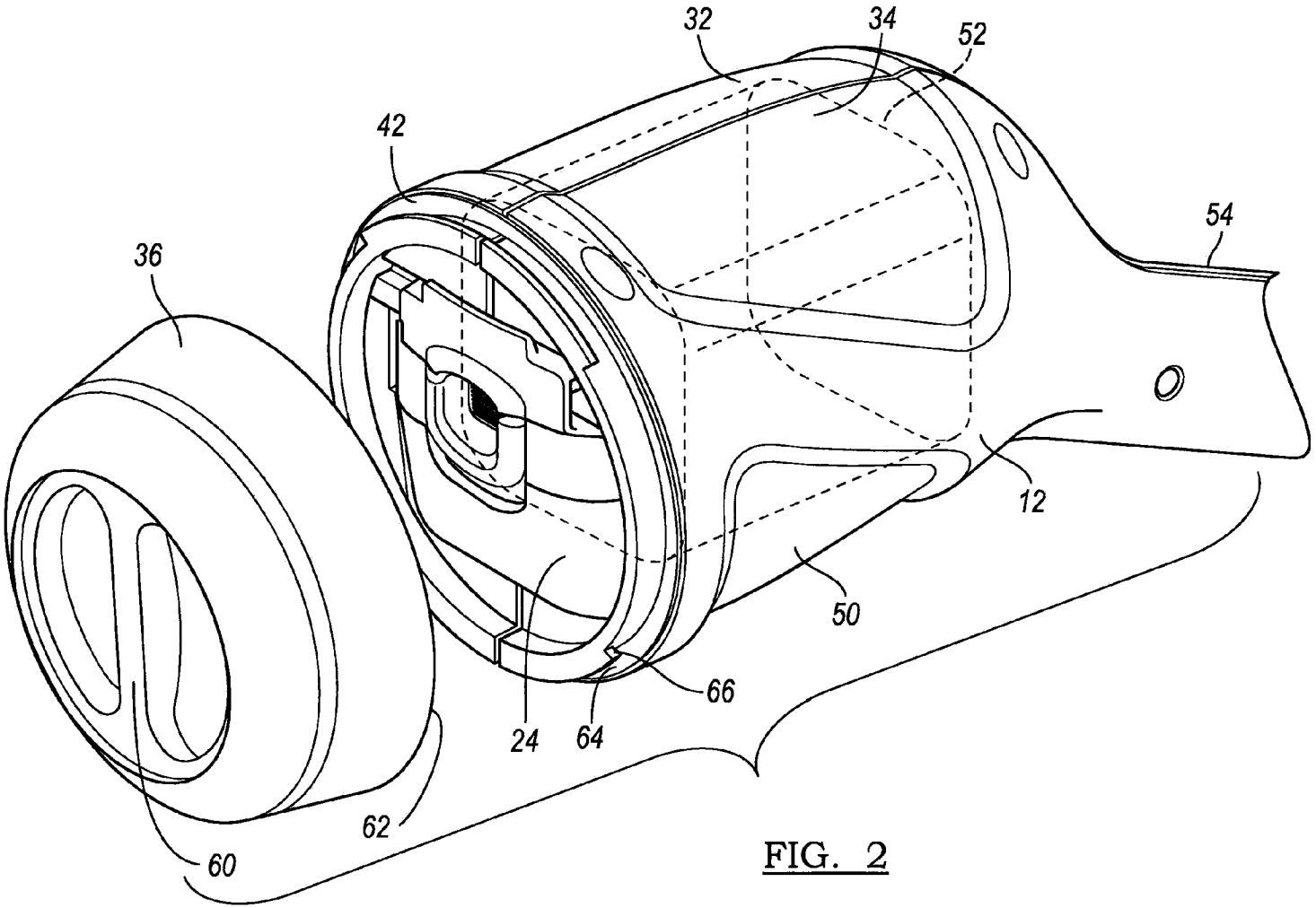
FIG. 2 is a perspective view of the pole scrubber of FIG. 1 illustrating a portion of the housing assembly with the cap removed.

With additional reference to FIG. 2, the housing assembly 12 can include first and second clamshells 32 and 34, respectively; a cap 36; a switch mount 38; a switch 40; a first seal member 42; a second seal member 44; and the battery 24. The first and second clamshells 32, 34 can define a housing structure 50 that can have an interior cavity 52, and a handle 54. The interior cavity 52 can be sized to receive the battery 24 and a wire harness WH. The wire harness WH can be employed to electrically couple the battery 24 to the switch 40 and the motor assembly 26.

The battery 24 can be any type of battery cell, such as nickel cadmium, nickel metal hydride, lithium ion, or alkaline battery, and can be permanently or removably received into the interior cavity 52. As will be appreciated, the battery 24 can further include a rechargeable battery or a replaceable/disposable battery and a terminal block (not shown) can be employed to electrically couple the battery 24 to the wiring harness. For example, the battery 24 can be a FIRESTORM® HPB14 14.4V or HPB18 18V battery pack marketed by Black & Decker Corporation of Towson, Md. In the example provided, a spring (not shown) is disposed between the housing structure 50 and the battery pack and biases the battery pack in a direction outwardly from the interior cavity 52. The connection of the battery pack to the wire harness (not shown) is outside the scope of this disclosure but can employ a terminal block as those of ordinary skill in the art will appreciate. An exemplary battery pack-terminal block interface is disclosed in U.S. Pat. No. 6,329,788 which is hereby incorporated by reference as if fully set forth in detail herein.

The cap 36 can include a cap handle 60 and first connector portion 62. The housing structure 50 can further include a shoulder 64; a second connector portion 66; and the first seal member 42, which can be an o-ring or a rubber disc that can be affixed (e.g., permanently) to the cap 36. The cap 36 can be coupled to the housing structure 50 by placing the cap 36 over the interior cavity 52 so that the first connector portion 62 can be translated past the second connector portion 66 and thereafter rotated to lockingly engage the first connector portion 62 to the second connector portion 66 and sealingly abut the cap 36 against the first seal member 42 and the first seal member 42 against the shoulder 64. The cap handle 60 can be employed to turn the cap 36 by a predetermined amount, such as about 90° in a predetermined rotational direction relative to the housing structure 50. It will be appreciated that although the first and second connector portions 62 and 66 are illustrated to be helical thread-like structures that matingly engage one another, various other types of coupling means can be employed in the alternative. For example, the cover 36 could be hingedly coupled to the housing structure 50.

Figure 3:
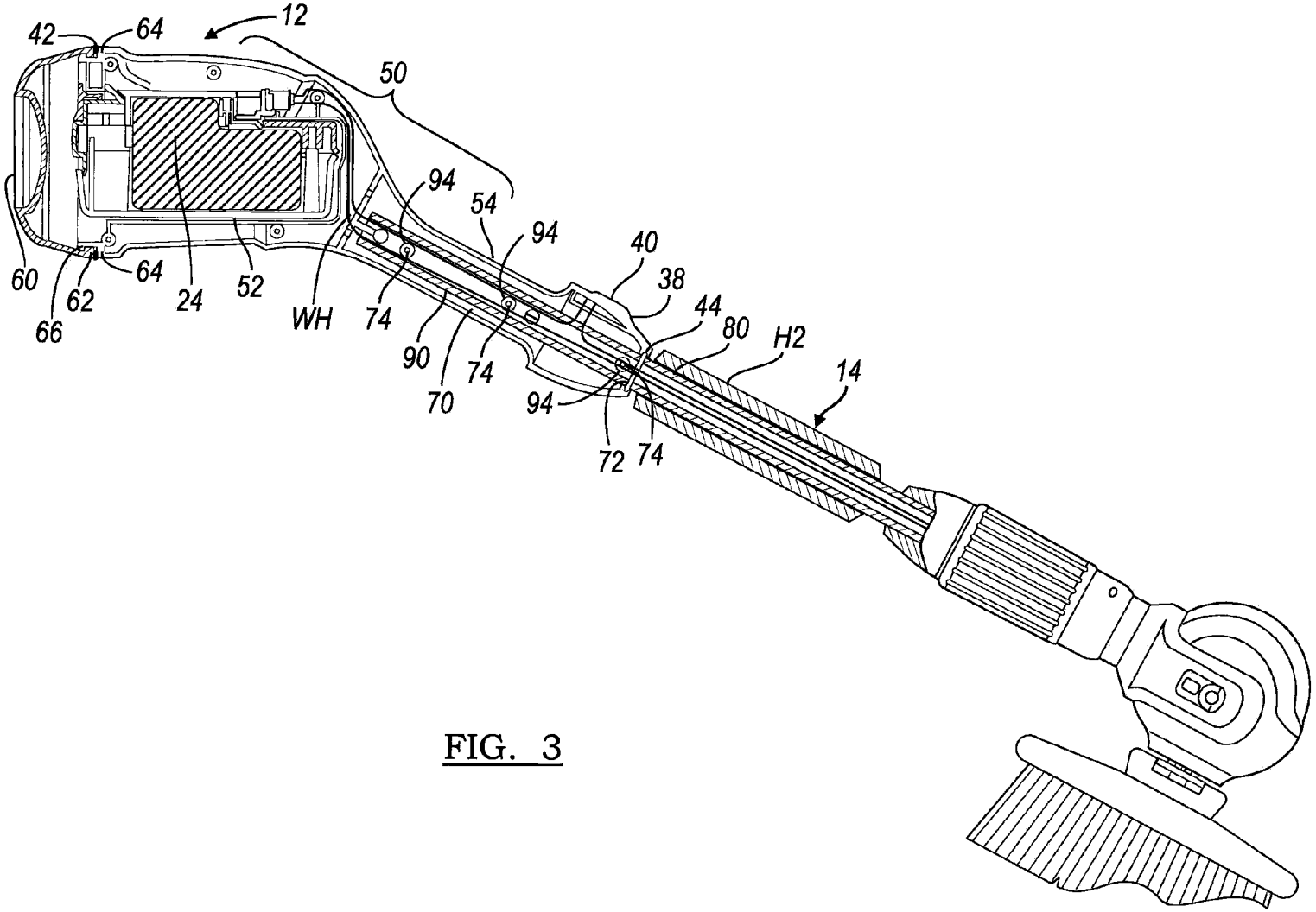
FIG. 3 is a longitudinal, cross-sectional view of the exemplary pole scrubber of FIG. 1.
Figure 4:
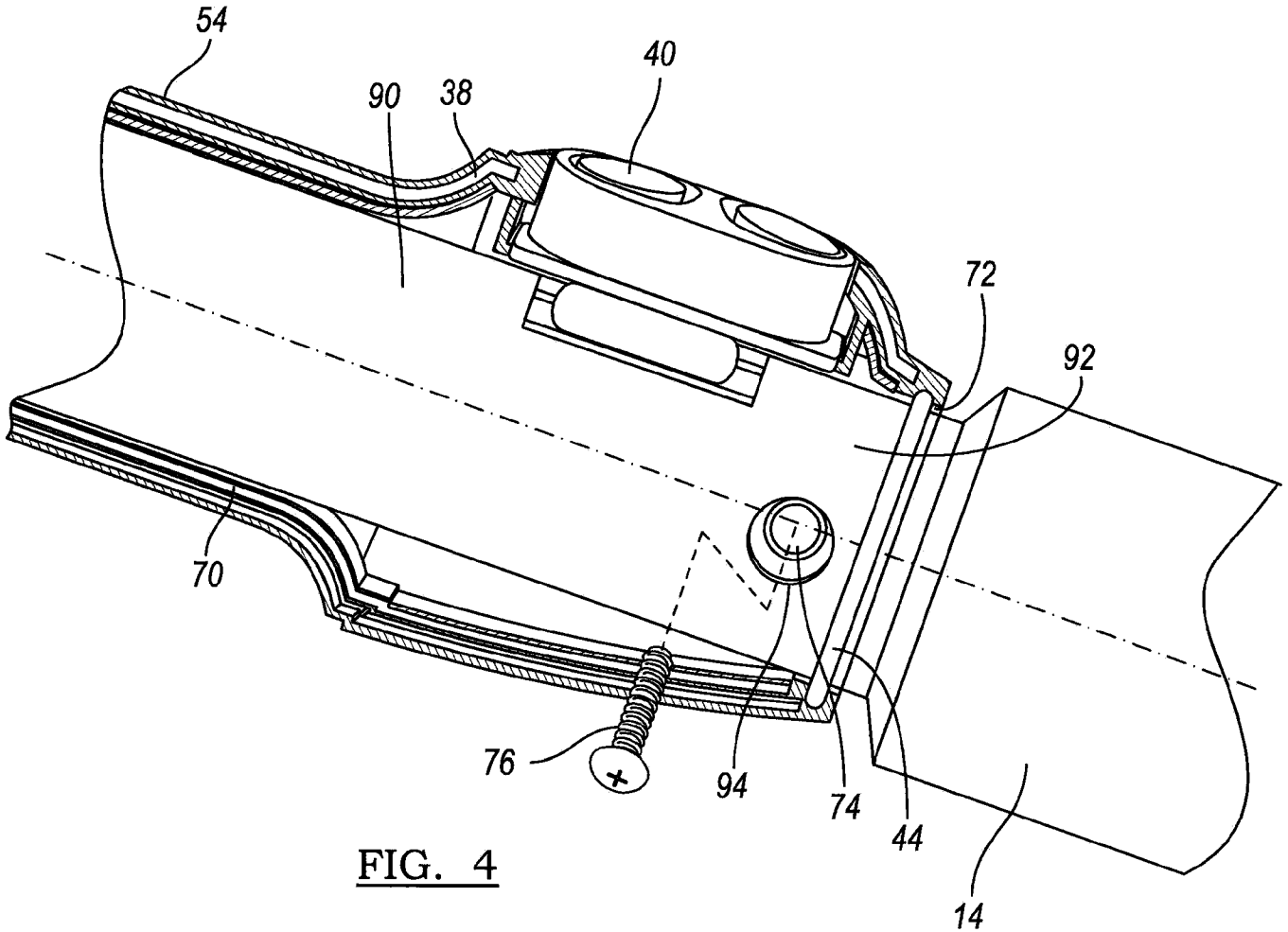
FIG. 4 is illustrates the coupling of the housing assembly and the support member, with the handle of the housing assembly shown in cross-section.

With reference to FIGS. 3 and 4, a first coupling portion 70 can be employed to couple the housing structure 50 to the support structure 14. The first coupling portion 70 can include an aperture 72, which can extend through the handle 54, and a plurality of bosses 74 that can extend inwardly from one or both of the first and second clamshells 32, 34. The aperture 72 can be configured to matingly receive a portion of the support structure 14. The bosses 74 can be received through the support structure 14 and can be employed to secure the first and second clamshells 32, 34 to one another in an appropriate manner, such as threaded fasteners 76, for example.

The handle 54 can be disposed between the battery 24 and the switch mount 38 and can be generally cylindrical in shape. The switch mount 38 can be employed to house the switch 40 and can form a guard that can extend around the switch 40 to resist inadvertent actuation of the switch 40. The switch 40 can be any type of switch, including a sealed or water-resistant switch, and can be employed to selectively control the transmission of electrical energy from the battery 24 to the motor assembly 26. The second seal member 44 can be employed to seal the interface between the housing assembly 12 and the support structure 14. In the particular example provided, the second seal member 44 is an o-ring that is located within the aperture 72 in the housing structure 50 and which sealing engages the support structure 14 and the housing structure 50.

The support structure 14 can be a one piece structure that can connect the housing assembly 12 to the yoke 16. In the example provided, however, the support structure 14 includes a support member 80 that can include a tubular body 82 and a second coupling portion 90 that can be engaged to the first coupling portion 70 of the housing structure 50 to thereby couple the support structure 14 to the housing assembly 12. In the particular example provided, the second coupling portion 90 includes a shaft portion 92 and a plurality of through-holes 94. The shaft portion 92 is sized to be received in the aperture 72 of the housing structure 50 and the through-holes 94 are sized to receive the bosses 74 to thereby non-rotatably couple the support member 80 to the housing assembly 12.

A second handle H2 can also be included on the support structure 14. The second handle H2 can be placed on the support structure 14 on a side of the center of gravity of the scrubbing device 10 opposite the housing assembly 12. Positioning the handle 54 and the second handle in this manner provides improved balance when the scrubbing device 10 is grasped with both handles.

Figure 5:
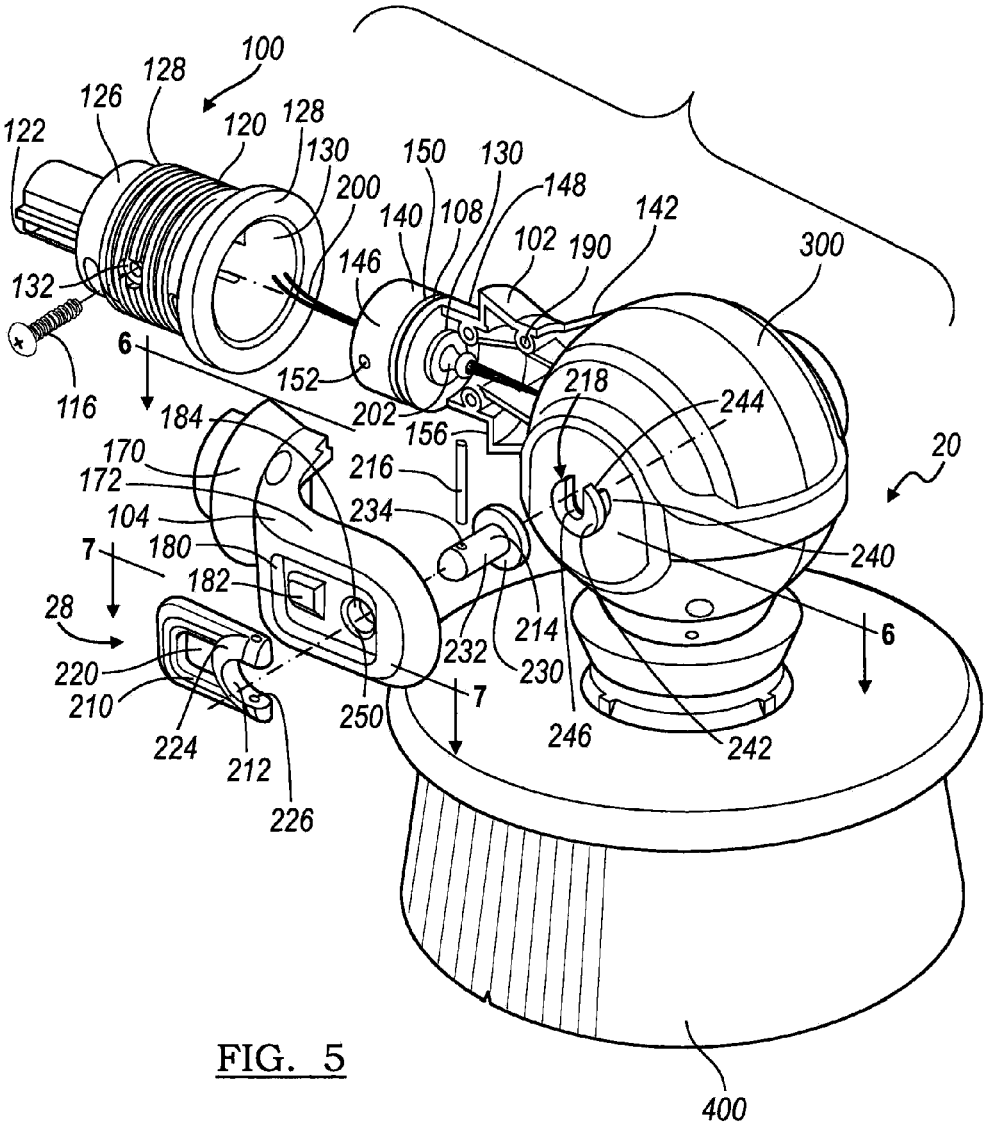
FIG. 5 is an exploded perspective view of a portion of the pole scrubber of FIG. 1 illustrating the cam lock coupling the yoke to the head assembly.
Figure 6:
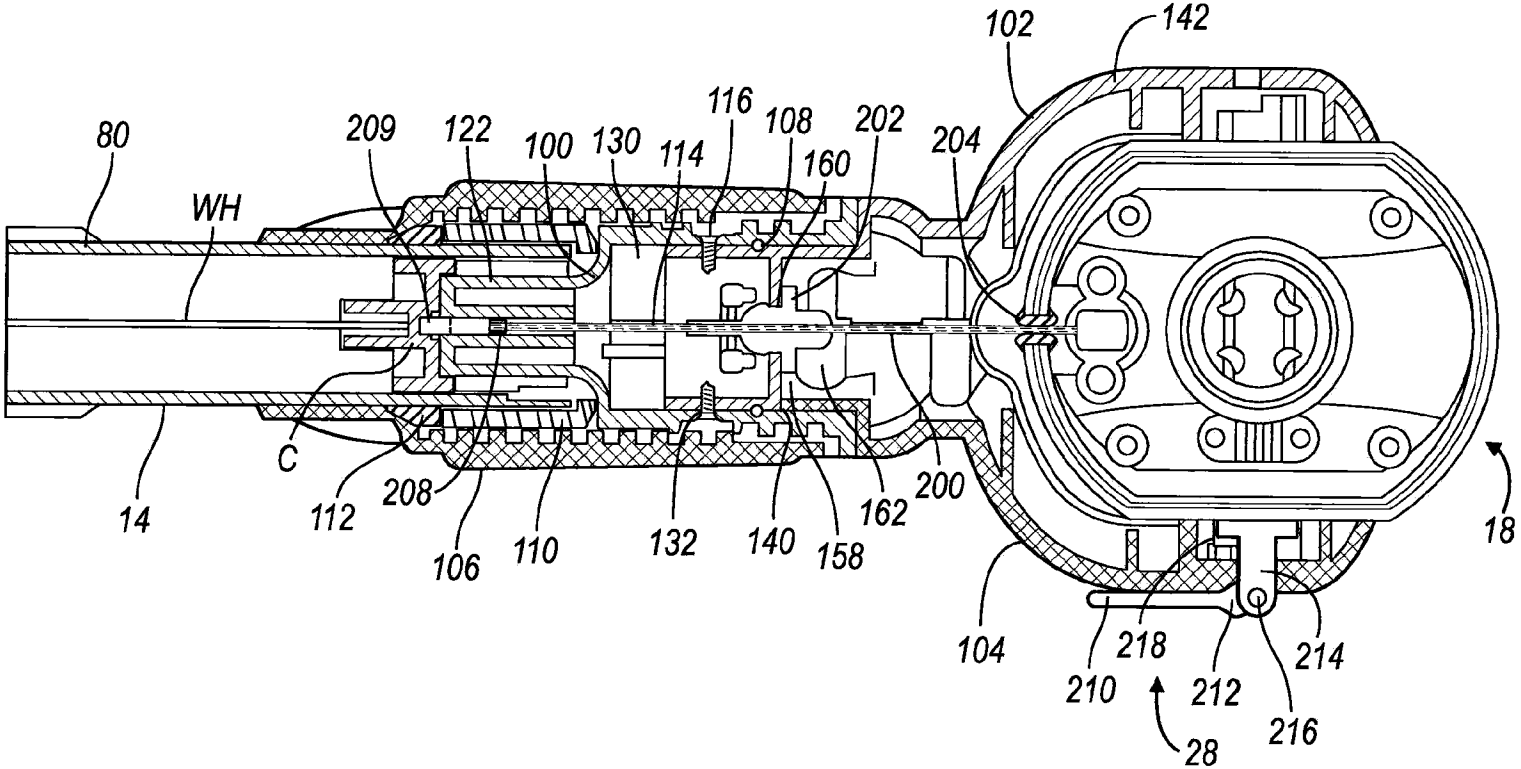
FIG. 6 is a cross-sectional view of the yoke coupled to the support member taken along line 6-6 of FIG. 1.

With reference to FIGS. 1, 5 and 6, the yoke 16 can include a yoke collar 100; first and second yoke arms 102 and 104, respectively; an outer cover 106; a first yoke seal 108; a spacer 110; a second yoke seal 112; an intermediate wire harness 114; and a fastener 116.

With specific reference to FIGS. 5 and 6, the yoke collar 100 can include a body 120 and a stem 122. The body 120 can have an annular wall member 126 and a flange 128 that extends radially outwardly from the annular wall member 126 on a side opposite the stem 122. The annular wall member 126 can be formed with a threaded outside diameter 128 and can define a yoke arm aperture 130 and a collar fastener aperture 132. The stem 122 can be coupled to the body 120 and can be sized to be received into an end of the support structure 14 opposite the handle 54. In the particular example provided, the stem 122 is also an electrical connector that can facilitate electrical connection of the wire harness WH to the intermediate wire harness 114.

The first yoke arm 102 can include a body portion 140 and a first arm member 142. The body portion 140 can be sized to be slidingly received into the yoke arm aperture 130 and can include a first body portion 146 and a second body portion 148. The first body portion 146 can be generally cylindrically shaped and can include a seal groove 150 and a fastener aperture 152. The second body portion 148 can have a shape that conforms to the outer surface of the first body portion 146 and can form a shoulder 156 where the second body portion 148 abuts the first arm member 142. A wire harness bore 158 can be formed through the body portion 140. The wire harness bore 158 can include a grommet bore 160, which can extend through the first body portion 146, and an opening 162 that can be defined by the second body portion 148. The first arm member 142 can be integrally formed with the body portion 140 and can have a one-half U shape that is configured to wrap around a portion of the head assembly 18.

The second yoke arm 104 can include a mating body portion 170 and a second arm member 172 that can be mirror images of the second body portion 148 and the first arm member 142, respectively, except as noted. Accordingly, it will be appreciated that the mating body portion 170 can have an exterior surface that is complementary to the exterior surface of the second body portion 148 and that the second arm member 172 can have a one-half U-shape that can wrap about a side of the head assembly 18 opposite the first arm member 142. The second arm member 172 can define a lever locking feature, such as a recess 180 and/or a tab 182, and a pin passage 184. The pin passage 184 can extend through the second arm member 172 on a side opposite the mating body portion 170 in a direction that is generally perpendicular to the lever locking feature (e.g., the recess 180 and the tab 182). In the particular example provided the first and second arm members 142 and 172 include a plurality of screw bosses 190 that can be employed to fixedly but removably couple the first and second yoke arms 102 and 104 to one another via a plurality of threaded fasteners (not shown). Such coupling means are well known in the art and as such, a detailed description of this coupling means need not be provided herein.

The intermediate wire harness 114 can extend through the wire harness bore 158 in the first yoke arm 102 and can include a plurality of wires 200, a first grommet 202 and a second grommet 204. The wires 200 can be electrically coupled to the wire harness WH and to the head assembly 18. In the particular example provided, the wires 200 are coupled to electrical terminals 208 that are mounted in the stem 122 of the yoke collar 100. The electrical terminals 208 are configured to matingly engage mating terminals 209 that are associated with a mating connector C that is electrically coupled to the wire harness WH. It will be appreciated that the mating connector C can be sealingly engaged to the support member 80. The first grommet 202 can be received in the grommet bore 160 and can sealingly engage the first body portion 146 and the wires 200.

The first yoke seal 108, which can be an O-ring, can be received into the seal groove 150. The yoke 16 can be inserted into the yoke collar 100 such that the body portion 140 and the mating body portion 170 are received into the yoke arm aperture 130, the first yoke seal 108 sealingly engages the annular wall member 126, the fastener aperture 152 is aligned to the collar fastener aperture 132 and the shoulders 156 defined by the second body portion 148 and the mating body portion 170 can be abutted against the flange 128. The fastener 116 can be received through the collar fastener aperture 132 and engage the body portion 140 to fixedly couple the first yoke arm 102 and the yoke collar 100. It will be appreciated that the first yoke seal 108 and the first grommet 202 can form a water resistant seal that inhibits fluids and debris from entering the interior of the pole scrubber 10 through the first yoke arm 102 or the interface between the first yoke arm 102 and the yoke collar 100.

The outer cover 106 can be disposed about a portion of the end of the support member 80 and can threadably engage the threaded outside diameter 128 of the yoke collar 100. The outer cover 106 can cover the fastener 116 to thereby inhibit its removal from the yoke collar 100. The second yoke seal 112 can be disposed between the outer cover 106 and the support member 80 to render the coupling between the yoke 16 and support structure 14 water-resistant. The spacer 110 can abut the second yoke seal 112 and the yoke collar 100 and can maintain the second yoke seal 112 in sealing engagement with the outer cover 106 and support structure 14. It will be appreciated that the outer cover 106, the spacer 110 and the second yoke seal 112 can be associated with and coupled to the support member 80 so as to remain with the support member 80 if the support structure 14 is separated from the yoke collar 100. It will also be appreciated that the yoke collar 100 and the support member 80 can be "keyed" to one another in any appropriate manner to facilitate electrical connection of the terminals 208 and 209 in a desired manner.

In the particular example provided, the capability to separate the support structure 14 from the yoke collar 100 permits additional support members, e.g., support members 80*a* and 80*b* (FIG. 1), to be disposed between the yoke collar 100 and the support member 80 to thereby extend the overall length of the support structure 14. In this regard, each of the support members 80*a* and 80*b* can include a tubular body with a first end 1000 (FIG. 1), which can electrically engage the connector C and threadably engage the outer cover 106 to thereby fixedly but removably electrically couple the support members, and a second end 1002 (FIG. 1) that can electrically engage the stem 122 of the yoke collar 100 and sealingly and threadably engage the body 120 of the yoke collar 100. As one of skill in the art will appreciate from this disclosure, the first end 1000 can be configured to mimic the portion of the yoke collar 100 that was described above as being engaged to the support member 80, and the second end 1002 can be configured to mimic the portion of the support member 80 that was described above as being engaged to the yoke collar 100. Those of skill in the art will further appreciate that the first and second ends 1000 and 1002 can be electrically coupled to one another through any appropriate means, such as a wire harness (not shown) that is disposed within the tubular body.

The cam lock 28 can include a lever 210, a cam 212, a lock member 214, a retaining pin 216 and a latch or pin receptacle 218. The lever 210 can define a tab aperture 220 and can be fixedly coupled (e.g., integrally formed with) to the cam 212. The tab aperture 220 can be sized to receive the tab 182, while the lever 210 can be sized to be received in the recess 180 in a particular orientation. The cam 212 can be generally U-shaped with a pair of arm members 224. A retaining pin aperture 226 can be formed through the distal ends of the arm members 224. The lock member 214 can include a circular head portion 230 and a pin portion 232 that is concentric with the circular head portion 230. The pin portion 232 can be received through the pin passage 184 in the second yoke arm 104. An aperture 234 can be formed through the pin portion 232 generally perpendicular to the longitudinal axis of the lock member 214. The retaining pin 216 can be disposed through the retaining pin apertures 226 in the cam 212 and the aperture 234 in the pin portion 232 to pivotally couple the cam 212 (and the lever 210) to the lock member 214. The pin receptacle 218 can be fixedly coupled to the head assembly 18 and can define first and second body members 240 and 242 that are fixedly coupled to one another. The first body member 240 can be disposed adjacent the head assembly 18 and can define a first U-shaped slot 244. The second body member 242 can be abutted against the first body member 240 on a side opposite the head assembly 18 and can define a second U-shaped slot 246 that can be narrower and shorter than the first U-shaped slot 244. The circular head portion 230 can be received into the first U-shaped slot 244 and the pin portion 232 can extend outwardly through the second U-shaped slot 246. It will be appreciated that the first body member 240 can be relatively thicker than the circular head portion 230 to provide lateral clearance for the circular head portion 230 that can permit the lock member 214 to rotate within the pin receptacle 218.

Figure 7:
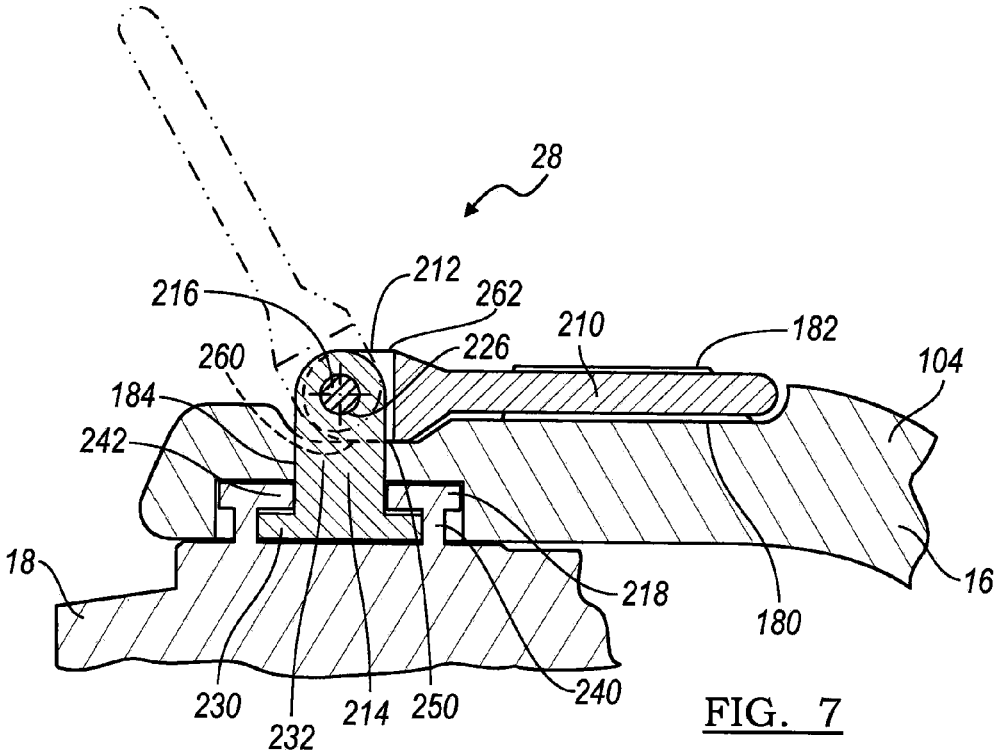
FIG. 7 is a cross-sectional view of the cam lock mechanism taken along line 7-7 of FIG. 5.

As illustrated in FIG. 7, the lever 210 of the cam lock 28 can be pivoted between a first position (shown in solid line proximate to the second yoke arm 104) and a second or change position (shown in phantom line radially outwardly of the first position). When the lever 210 is in the first position, the cam 212 can engage the outboard face 250 of the second yoke arm 104 to draw the lock member 214 outwardly from the pin receptacle 218. It will be appreciated that the second arm member 172 can deflect somewhat (i.e., like a spring) when the lever 210 is in the first position to exert a force that is applied through the cam 212 to the lock member 214 and the pin receptacle 218. Those of ordinary skill in the art will appreciate from this disclosure that the cam 212 could be configured to generate a force that is sufficient to tightly draw the circular head portion 230 against the second body member 242 to thereby inhibit rotation between the lock member 214 and the pin receptacle 218. In contrast, when the lever 210 is positioned in the second position, the cam 212 can disengage the outboard face 250 of the second yoke arm 104 to permit the circular head portion 230 to disengage the second body member 242 to thereby permit relative rotation between the lock member 214 and the second arm member 172. Accordingly, those of skill in the art will appreciate that the lever 210 can be moved to the second position to permit the head assembly 18 to be rotated to a desired position and the lever 210 can thereafter be moved to the first position to secure the head assembly 18 in the desired position. Additional functionality of the cam lock 28 is described in more detail, below.

The lever 210 can at least partially fit within the lever receiving pocket 180 of the first yoke arm 102 and the tab 182 can be received into the tab aperture 220 when the lever 210 is positioned in the first position. It will be appreciated that the disposition of the lever 210 in the lever receiving pocket 182 helps to inhibit rotation of the lever 210 relative to the second yoke arm 104. It will be further appreciated that the disposition of the tab 182 in the tab aperture 220 can also help to inhibit rotation of the lever 210 relative to the second yoke arm 104.

With reference to FIG. 7, the cam 212 can includes a first cam portion 260 and a second cam portion 262. The first cam portion 260 can be configured to develop a first force that is sufficient to clamp the circular head portion 230 of the lock member 214 to the second body member 242 of the pin receptacle 218 when the lever 210 is positioned in the first position and the first cam portion 260 is abutted against the outboard face 250 of the second yoke arm 104 to thereby lock the head assembly 18 relative to the yoke 16. As noted above, the head assembly 18 may be selectively fixed in a given position relative to the yoke 16.

When the lever 210 is pivoted outward to the second position, the lever 210 and cam 212 can be rotated about the longitudinal axis of the lock member 214 to align the second cam portion 262 to the second yoke arm 104 (i.e., so that the second cam portion 262 will abut the outboard face 250 when the lever 210 is returned to the first position). The second cam portion 262 can be configured such that a second force, which has a magnitude that is less than a magnitude of the first force, is generated when the lever 210 is positioned in the first position and the second cam face is abutted against the outboard face 250. The second force can be light enough to permit the head assembly 18 to pivot (e.g., freely or with some resistance) relative to the yoke 16.

In this regard, the center of the coupling aperture 226 in the cam 212 can be offset such that the distance from the center to the first cam portion 260 on one side of the cam 212 is greater than the distance from the center to the second cam portion 262 on the other side of the cam 212. Consequently, placing the lever 210 in the first position proximate to the second yoke arm 104 can either engage the cam lock 28 and fix the head assembly 18 relative to the yoke 16 (when the first cam portion 260 faces and abuts the outboard face 250) or can allow the head assembly 18 to freely pivot relative to the yoke 16 assembly (when the second cam portion 262 faces and abuts the outboard face 250) depending upon which of the first and second cam portions 260 and 262 is engaged against the outboard face 250.

Returning to FIG. 6, the first yoke arm 102 can be pivotably coupled to the head assembly 18 by using a cam lock 28 as described for the second yoke arm 104 or by suitable coupling methods known in the art. Typically, the coupling of the first yoke arm 102 to the head assembly 18 is by a pin 270 that rotatably couples the first yoke arm 102 to the head assembly 18. In this manner, only the cam lock 28 that is associated with the second yoke arm 104 need be operated to lock or pivot the head assembly 18 relative to the yoke 16. Those of skill in the art will appreciate that the pin 270 could be a discrete component as shown, or could be integrally formed with one of the first yoke arm 102 and the head assembly 18 and could engage a hole (not shown) that is formed in the other one of the first yoke arm 102 and the head assembly 18.

Figure 8:
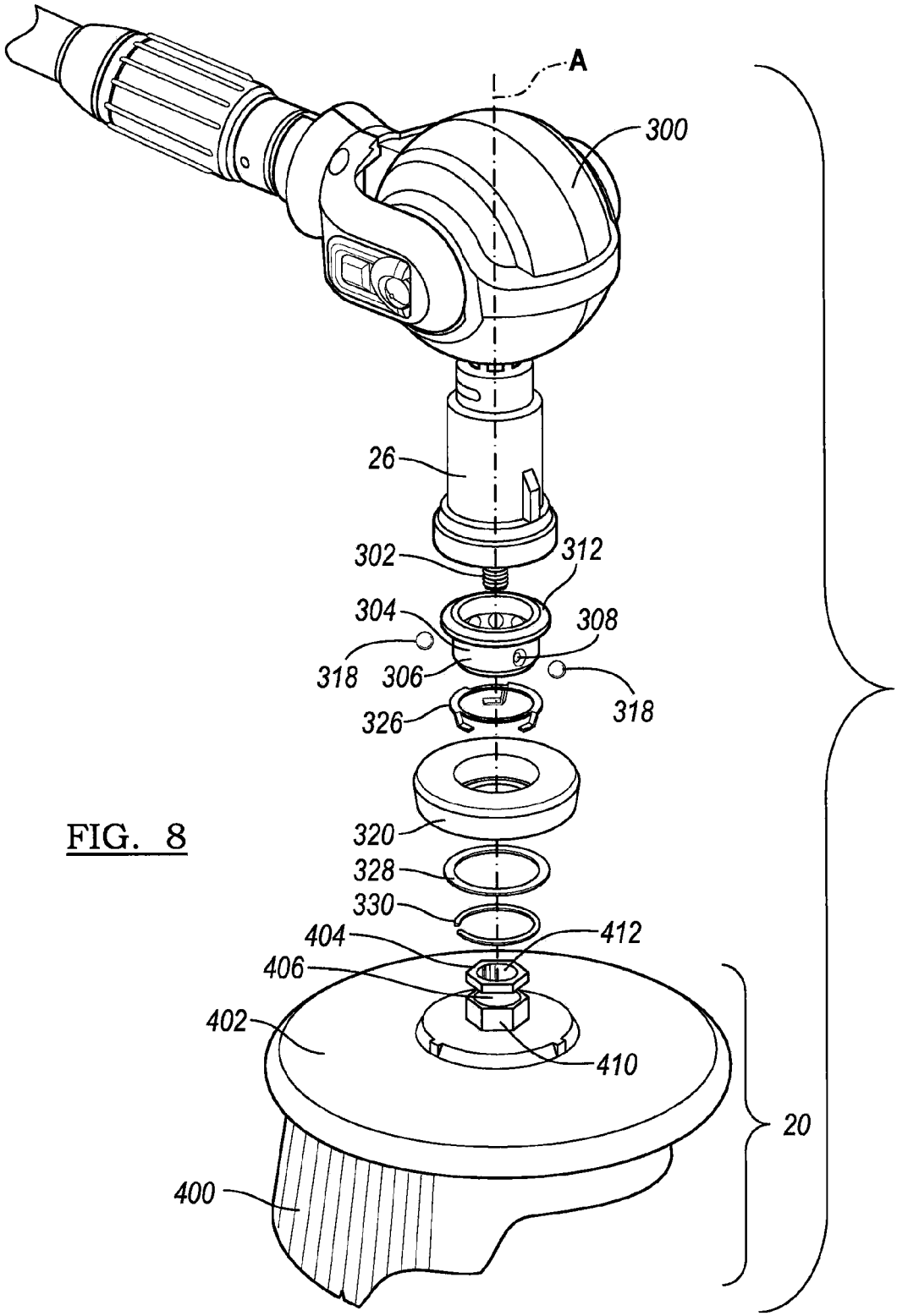
FIG. 8 is an exploded perspective view of a portion of the pole scrubber of FIG. 1 illustrating the head assembly and the accessory.

With reference to FIG. 8, the head assembly 18 can include a housing 300, the motor assembly 26, which can have an output shaft 302, and an output member 304. The housing 300 can be a two piece clam-shell type construction that is sealed to prevent water from entering the head assembly 18 and contacting the motor assembly 26. The motor assembly 26 can include an electric motor (not specifically shown) and a transmission (not shown) that can have a planetary gearset, gearcase, and seals (not shown), which are sealed into a single integral unit. Such motor assemblies are well known in the art (see, e.g., U.S. Pat. No. 5,978,999 entitled "Motorized Scrub Brush With Multiple Hand Holding Positions", the disclosure of which is hereby incorporated by reference as if fully set forth in detail herein).

Figure 9:
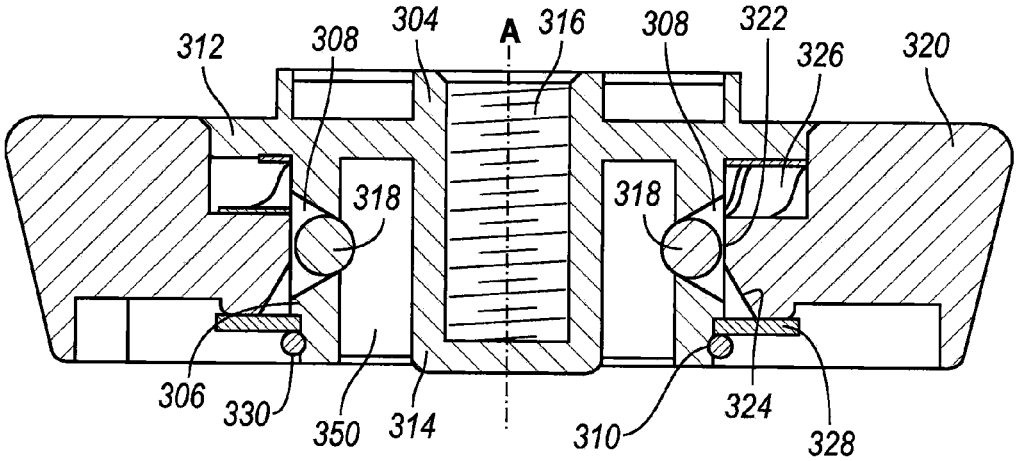
FIG. 9 is a cross-sectional view of the output member coupled to the release ring taken along line 8-8 of FIG. 1.

With additional reference to FIG. 9, the output member 304 can be coupled for rotation with the output shaft 302 and can include a hub portion 306 with a plurality of detent passages 308, a groove 310, a flange portion 312, a shaft portion 314, and a output shaft engagement aperture 316; a plurality of detent members 318; a release ring 320 having a first ring portion 322 and a second ring portion 324; a spring 326, a washer 328; and a retaining ring 330.

The detent passage 308 extends radially outwardly through the hub portion 306 of the output member 304, while the flange portion 312 extends circumferentially outward from one end of the hub portion 306. The shaft portion 314 can extend along a rotational axis A and can form the output shaft engagement aperture 316. In the particular example provided, the output shaft engagement aperture 316 is threaded to receive a threaded end of the output shaft 302. Alternatively, the output shaft engagement aperture 316 could be formed with flat sides (not shown) and the output shaft 302 could be shaped as a flat fir-tree that is forced into the output shaft engagement aperture 316.

The hub portion 306 can define an accessory connector aperture 350 that can have a shape that can receive a shaft portion of an accessory and transmit drive torque therebetween. In this regard, the accessory connector aperture 350 can have a non-circular shape, such as a hex shape. The detent passages 308 can intersect the accessory connector aperture 350.

The detent members 318, which can be spherical balls, can be received in the detent passages 308. The spring 326 can be disposed about the hub 306 and abutted against the flange portion 312. The release ring 320 can received over the hub 306 and abutted against the spring 326, which biases the release ring 320 away from the flange portion 312. The washer 328 and the retaining ring 330 can be employed to limit the distance by which the release ring 320 is positioned away from the flange portion 312 by the spring 326. In its "normal" position, which is illustrated in FIG. 9, the spring 326 can position the release ring 320 such that the first ring portion 322, which can be generally cylindrically shaped and sized to approximately match the outside diameters of the hub 306, can be located radially in-line with the detent member 318. Accordingly, the first ring portion 322 can be employed to maintain the detent members 318 in a first or radially inward location where it is positioned in the accessory connector aperture 350.

The release ring 320 may be manually moved in a direction parallel to the rotational axis A to align the second ring portion 324 to the detent members 318. In the particular example provided, the second ring portion 324 is radially outwardly tapered from the first ring portion 322 and as such, movement of the release ring 320 toward the flange portion 312 by a sufficient distance will permit the detent members 318 to translate radially outwardly to a second position so that it does not extend into the accessory connector aperture 350.

The accessory 20 can include an accessory portion 400, shown as a brush, and the accessory connector 402 having the drive portion 404 and a retaining portion 406. The retaining portion 406 is shown as a circumferential detent that is formed about the perimeter of the drive portion 404. The drive portion 404 can be sized and shaped to fit within the accessory connector aperture 350. In the particular example provided, the drive portion 404 has a hex-shaped outer surface 410, which slidingly engages the accessory connector aperture 350, and an aperture 412 that is sized to receive the shaft portion 314 therein. The retaining portion 406 can be configured to cooperate with the detent members 318 to fixedly but releasably couple the accessory 20 to the hub portion 306. In the particular example provided, the retaining portion 406 is a groove that extends about the circumference of the drive portion 404 having a generally circular cross-sectional shape that is configured to receive the detent members 318 when the drive portion 404 is inserted into the accessory connector aperture 350. The retaining portion 406 provides space in a radially inwardly direction for the detent members 318 when the detent members 318 are urged radially inwardly by the first ring portion 322 of the release ring 320.

The accessory 20 can be coupled to the head assembly 18 by urging the release ring 320 against the spring 326 that disposed between the release ring 320 and the flange portion 312 of the output member 304. This moves the first ring portion 322 of the release ring 320 away from the detent members 318 and brings the second ring portion 324 of the release ring 320 towards the detent members 318. The second ring portion 324 permits the detent members 318 to move from a first detent position generally radially outwardly in the detent passage 308 to a second detent position. The drive portion 404 of the accessory connector 402 is then disposed between the hub portion 306 and the shaft portion 314 of the output member 304, unobstructed by the detent members 318. Once the retaining portion 406 of the accessory connector 402 is aligned with the detent passage 308, the spring 326 is allowed to return the release ring 320 to its original position, with the first ring portion 322 of the release ring 320 moving the detent member 318 from the second position back to the first position where the detent members 318 engage the retaining portion 406 of the accessory connector 402, thereby retaining the accessory 20 coupled to the head assembly 18.

Alternative features can be incorporated into various aspects of the scrubbing device 10 as disclosed. Non-limiting examples of various accessory portions 400 include pads, brushes, sponges and combinations thereof. In addition, various features of the present disclosure can be made water-resistant such that the pole scrubber can be operated in wet conditions or even submerged. Furthermore, various motorized drive actions can be employed for powering the accessory, including rotary, orbital, and reciprocating drives. Alternatively, a yoke 16 with a single yoke arm can be used.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A scrubbing device comprising:

a support member;

a battery;

a yoke coupled to the support member, the yoke having a yoke arm;

a head assembly having an electric motor and an output member, the electric motor being electrically coupled to the battery, the output member being driven by the electric motor and adapted to be coupled to a scrubbing accessory; and a cam lock releasably coupling the yoke arm and the head assembly together, the cam lock comprising a lock member and a lever, the lock member having a first end and a second end opposite the first end, the first end being engaged to the head assembly, the second end extending through the yoke arm, the lever having a cam that is pivotally coupled to the second end of the lock member;

wherein pivoting the cam moves the lock member in a direction that is parallel to an axis about which the head assembly is pivotable relative to the yoke.

2. The scrubbing device of claim 1, wherein the cam lock further comprises a latch that receives the first end of the lock member, the latch being configured to hold the first end, and wherein the cam lock is operable in an engaged condition, which inhibits relative rotation between the latch and the first end, and a disengaged condition that permits relative rotation between the latch and the first end.

3. The scrubbing device of claim 1, wherein the cam includes a first cam portion and a second cam portion, wherein engagement of the first cam portion to the yoke arm inhibits relative rotation between the head assembly and the yoke, and wherein engagement of the second cam portion to the yoke arm permits relative rotation between the head assembly and the yoke.

4. The scrubbing device of claim 3, wherein the lever includes a handle portion that is movable between a first position, which is proximate an outer surface of the yoke member, and a second position radially outwardly of the first position, wherein placement of handle portion in the first position such that a first side of the handle portion is proximate the outer surface of the yoke member operates the cam lock in the engaged condition and wherein placement of the handle portion in the first position such that a second side of the handle portion is proximate the outer surface of the yoke member operates the cam lock in the disengaged condition.

5. The scrubbing device of claim 4, wherein a coupling aperture is formed through the cam and wherein the center of the coupling aperture is offset such that a distance from the first side to the center is greater than a distance from the second side to the center and wherein a pin is received through the coupling aperture and engaged to the lock member.

6. The scrubbing device of claim 1, further including a sealed housing assembly coupled to the support member, the sealed housing assembly defining a cavity into which the battery is disposed.

7. The scrubbing device of claim 6, wherein the sealed housing assembly includes a housing structure and a cap that is removably coupled to the housing structure.

8. The scrubbing device of claim 6, wherein the sealed housing assembly includes a handle and a switch.

9. The scrubbing device of claim 1, further comprising:

a first handle coupled to one of the battery and the support member; and a second handle coupled to the support member, the second handle being disposed on a side of a center of gravity of the scrubbing device opposite the first handle.

10. The scrubbing device of claim 1, wherein the support member includes a first support member and a second support member that is received into the first support member.

11. The scrubbing device of claim 1, wherein the accessory includes a member selected from a group consisting of pads, brushes, sponges and combinations thereof.

12. The scrubbing device of claim 1, wherein the head assembly further comprises:

a detent member disposed within a detent passage formed in the output member, the detent member being movable between a first detent position and a second detent position that is radially outwardly of the first detent position; and a release ring disposed coaxially about at least a portion of the output member, the release ring defining a first ring portion and a second ring portion, the first ring portion being configured to maintain the detent member at or inwardly of the first detent position, the second ring portion being configured to permit the detent member to travel radially outwardly from the first detent position to the second detent position.

13. A scrubbing device comprising:

a support member;

a battery;

a yoke coupled to the support member, the yoke having a yoke arm;

a head assembly having an electric motor and an output member, the electric motor being electrically coupled to the battery, the output member being driven by the electric motor and adapted to be coupled to a scrubbing accessory; and a cam lock releasably coupling the yoke arm and the head assembly together;

wherein the cam lock comprises a lock member and a lever, the lock member having a first end and a second end opposite the first end, the first end being engaged to the head assembly, the second end extending through the yoke arm, the lever having a cam that is pivotally coupled to the second end of the lock member;

wherein the cam includes a first cam portion and a second cam portion, wherein engagement of the first cam portion to the yoke arm inhibits relative rotation between the head assembly and the yoke, and wherein engagement of the second cam portion to the yoke arm permits relative rotation between the head assembly and the yoke; and wherein the lever includes a handle portion that is movable between a first position, which is proximate an outer surface of the yoke member, and a second position radially outwardly of the first position, wherein placement of the handle portion in the first position such that a first side of the handle portion is proximate the outer surface of the yoke member operates the cam lock in the engaged condition and wherein placement of the handle portion in the first position such that a second side of the handle portion is proximate the outer surface of the yoke member operates the cam lock in the disengaged condition.

14. The scrubbing device of claim 13, wherein a coupling aperture is formed through the cam and wherein the center of the coupling aperture is offset such that a distance from the first side to the center is greater than a distance from the second side to the center and wherein a pin is received through the coupling aperture and engaged to the lock member.

15. A scrubbing device comprising:

a support member;

a battery;

a yoke coupled to the support member, the yoke having a yoke arm;

a head assembly having an electric motor and an output member, the electric motor being electrically coupled to the battery, the output member being driven by the electric motor and adapted to be coupled to a scrubbing accessory; and a cam lock releasably coupling the yoke arm and the head assembly together;

wherein the head assembly further comprises:

a detent member disposed within a detent passage formed in the output member, the detent member being movable between a first detent position and a second detent position that is radially outwardly of the first detent position; and a release ring disposed coaxially about at least a portion of the output member, the release ring defining a first ring portion and a second ring portion, the first ring portion being configured to maintain the detent member at or inwardly of the first detent position, the second ring portion being configured to permit the detent member to travel radially outwardly from the first detent position to the second detent position.

16. A device comprising:

a handle;

a yoke coupled to the handle;

a motor assembly pivotally coupled to the yoke, the motor assembly including a motor, an output member and a coupling, the output member being driven by the motor, the coupling including a detent member and a release ring, the detent member being disposed within a detent passage formed in the output member, the detent member being movable between a first detent position and a second detent position that is radially outwardly of the first detent position, the release ring being disposed coaxially about at least a portion of the output member, the release ring defining a first ring portion and a second ring portion, the first ring portion being configured to maintain the detent member at or inwardly of the first detent position, the second ring portion being configured to permit the detent member to travel radially outwardly from the first detent position to the second detent position.

17. The device of claim 16, wherein the coupling further comprises a spring that biases the release ring into a position in which the first ring portion is in-line with the detent member.

18. The device of claim 16, wherein the detent member is spherically-shaped.

* * * * *